US007387353B2

(12) United States Patent
Saksa

(10) Patent No.: US 7,387,353 B2
(45) Date of Patent: Jun. 17, 2008

(54) FLUID EJECTING METHODS AND RELATED CIRCUITS

(75) Inventor: Thomas A. Saksa, Albany, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 426 days.

(21) Appl. No.: 11/079,128

(22) Filed: Mar. 14, 2005

(65) Prior Publication Data

US 2005/0156966 A1 Jul. 21, 2005

Related U.S. Application Data

(63) Continuation-in-part of application No. 10/285,173, filed on Oct. 31, 2002, now Pat. No. 6,908,183.

(51) Int. Cl.
*B41J 29/38* (2006.01)
*B41J 2/175* (2006.01)

(52) U.S. Cl. ..... 347/9; 347/87; 310/317

(58) Field of Classification Search ..... 347/9
See application file for complete search history.

(56) References Cited

U.S. PATENT DOCUMENTS 4,005,435 A 1/1977 Lundquist et al.
4,065,775 A 12/1977 Hou et al.
4,768,057 A * 8/1988 Kumada et al. ..... 399/336
5,422,664 A 6/1995 Stephany
5,537,287 A * 7/1996 Dreier ..... 361/119
5,650,807 A 7/1997 Abe et al.
5,852,549 A * 12/1998 Heeringa ..... 363/18
6,339,314 B1 1/2002 Bruning
6,353,295 B1 * 3/2002 Sridhar et al. ..... 315/248
6,759,766 B2 * 7/2004 Hiratsuka et al. ..... 307/110
6,979,933 B2 * 12/2005 Oudshoorn et al. .... 310/316.03
7,125,101 B2 * 10/2006 Cruz-Uribe et al. ..... 347/51

* cited by examiner

*Primary Examiner*—Matthew Luu
*Assistant Examiner*—Shelby Fidler

(57) ABSTRACT

An energizing circuit and methods and systems for same are described. One exemplary energizing circuit incorporated into a fluid ejecting device includes a piezoelectric actuator configured to selectively eject fluid from the fluid ejecting device. The circuit also includes an avalanched device electrically coupled to the piezoelectric actuator and configured to be triggered at a predetermined voltage level, and wherein the triggering of the avalanche device causes the piezoelectric actuator to be activated sufficiently to cause fluid to be ejected from the fluid ejecting device.

22 Claims, 7 Drawing Sheets

FLUID EJECTING METHODS AND RELATED CIRCUITS

PRIORITY

This application is a continuation-in-part and claims priority from a application titled, "Fluid Ejecting Methods and Related Circuits", filed on Oct. 31, 2002, and having application Ser. No. 10/285,173 now U.S. Pat. No. 6,908,183.

BACKGROUND

Existing ink jet printing devices employ complex circuitry and components to enable hundreds of fluid-ejecting devices to be fired cooperatively to achieve a desired image. However, many applications for fluid-ejecting devices have remained undeveloped because of the expense of such circuitry and components. Many applications for fluid-ejecting devices do not utilize the selective control utilized in an ink jet printer. Similarly, many potential applications can employ fewer, or in some cases, a single fluid-ejecting device(s). For such applications the existing circuitry and components for energizing the fluid-ejecting devices can be unnecessarily complicated and prohibitively expensive.

BRIEF DESCRIPTION OF THE DRAWINGS

The same components are used throughout the drawings to reference like features and components.

DETAILED DESCRIPTION

Overview

The embodiments described below pertain to energizing circuits. In some embodiments, suitable energizing circuits can store energy from a battery and ultimately deliver a pulse of energy sufficient to activate an energizing element of a fluid ejecting device. Activation of the energizing element causes fluid to be ejected from the fluid ejecting device.

First Exemplary Embodiment

Figure 1:
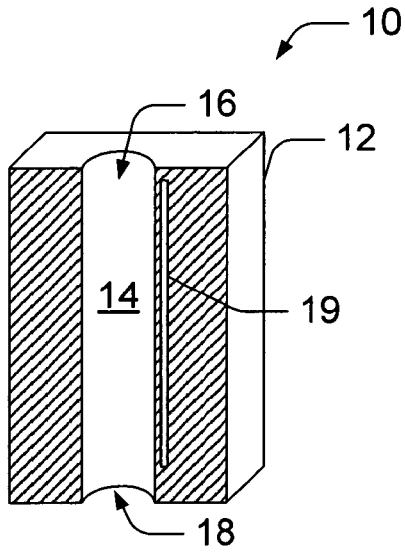
FIG. 1 shows a cross-sectional view of an exemplary fluid ejecting device in accordance with one embodiment.

FIG. 1 shows a cross-sectional view of an exemplary fluid-ejecting device 10 formed in a substrate 12. A firing chamber 14 is formed in the substrate and receives fluid in one portion of the firing chamber (shown generally at 16) and ejects fluid from another portion of the firing chamber (shown generally at 18). An energizing element 19 proximate the firing chamber 14 can energize the fluid contained therein to cause a portion of the fluid to be expelled. Examples of energizing elements 19 include firing resistors and piezoelectric crystals among others.

In at least some implementations, a fluid ejecting device ejects fluid when a sufficient pulse of energy is supplied to activate the fluid ejecting device's energizing element. Once the energizing element has been activated, fluid is ejected and a period of time is allowed for the fluid ejecting device to refill before the next pulse is supplied. Various suitable fluid ejecting devices utilize varying energizing sequences as will be recognized by the skilled artisan.

Figure 2:
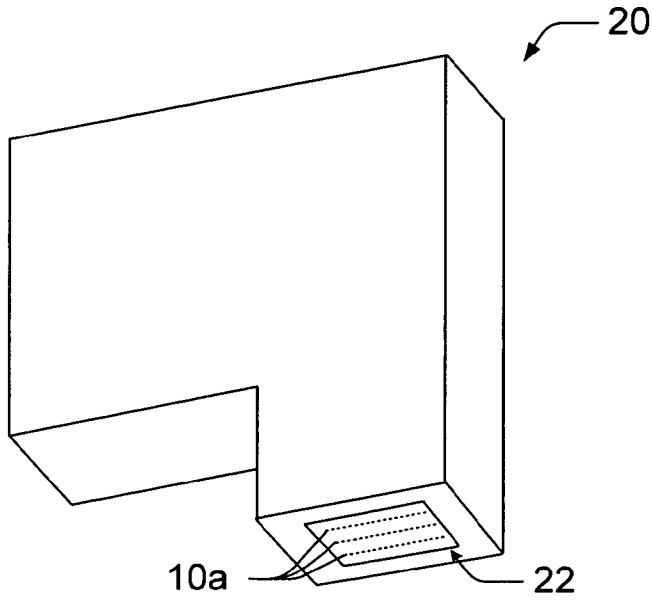
FIG. 2 shows a perspective view of an exemplary print cartridge in accordance with one embodiment.

FIG. 2 illustrates a print cartridge 20 which is a commonly recognized use of fluid-ejecting devices 10*a*. Such a print cartridge is configured for use in various consumer devices such as an ink jet printer. In such an application, multiple fluid-ejecting devices 10*a* are positioned on a print head 22. In various applications, the fluid-ejecting devices are selectively energized by a processor, a controller, a print head driver circuit, a controlled voltage power supply, and related circuitry coupled to the print head to cooperatively form a desired image on a print media. An example of such a configuration is shown at U.S. Pat. No. 6,183,046.

Many potential consumer devices can utilize fluid ejecting devices as advantageous fluid delivery systems. A consumer device can be any product available to consumers either for personal or business applications. One such exemplary consumer device is described in relation to FIG. 3.

Figure 3:
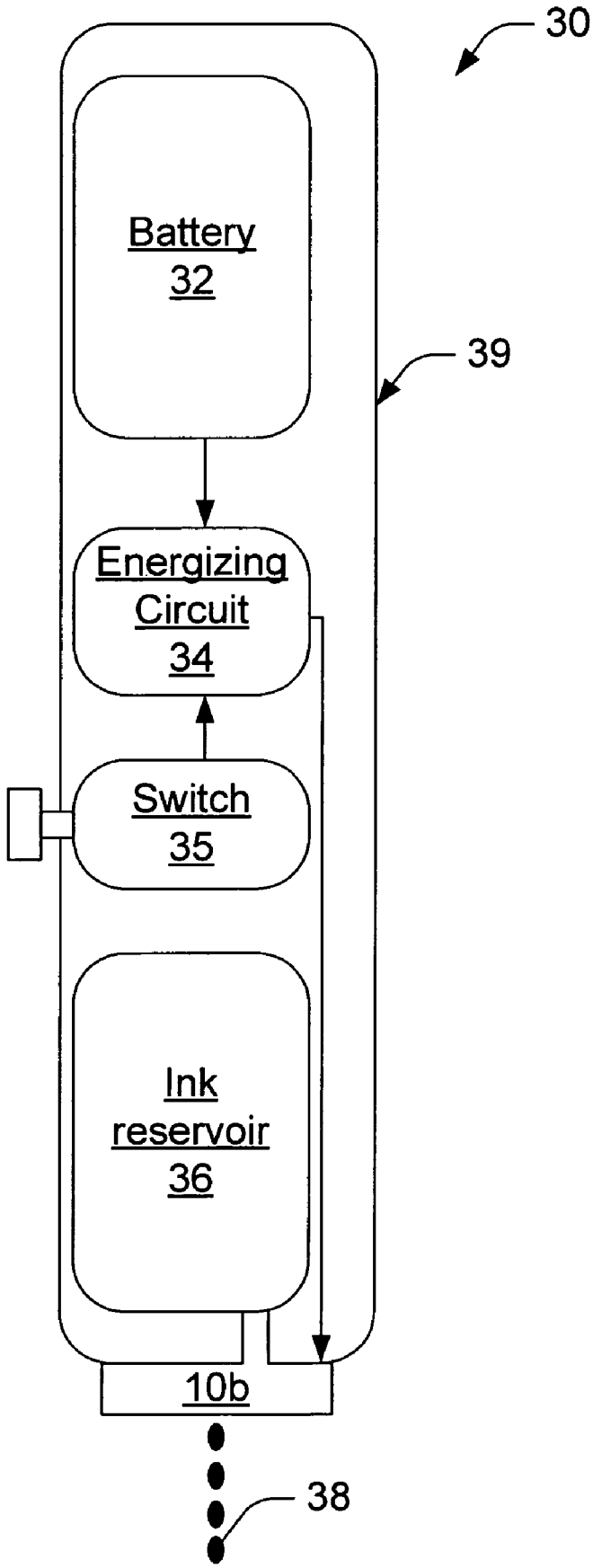
FIG. 3 shows a diagrammatic view of an exemplary consumer device in accordance with one embodiment.

FIG. 3 shows a consumer device embodied as an air brush 30. The air brush 30 includes a power source that, in this embodiment, comprises a battery 32. The air brush 30 also comprises an energizing circuit 34, a switch 35, an ink reservoir 36, and a fluid-ejecting device 10*b* for ejecting ink 38. The various components can be positioned in a housing 39.

A user can control the function of the air brush 30 via the switch 35. When the user closes the switch 35, electrical energy can flow from the battery 32 through the energizing circuit 34. The energizing circuit activates the fluid ejecting device 10*b* to eject ink 38. The user can, as desired, open the switch to stop ink flow.

In this configuration, the air brush 30 is self-contained and portable. It can be utilized for applying ink or other fluids to a surface without physically contacting the surface. Such a configuration is desirable for artistic applications, among others.

FIG. 3 represents but one suitable consumer device utilizing a fluid ejecting device. Many other suitable applications include devices that can utilize similar fluid ejecting devices. For example, other consumer devices may be utilized to deliver various liquids in a laboratory setting. In one such embodiment, a desired amount of a reagent can be dispensed where the fluid ejecting device ejects a generally consistent volume of fluid when the energizing element is activated. The device can then be activated an appropriate number of times and/or for a given duration of time to deliver a desired volume of fluid. Such devices can be advantageous in that no contact is required to deliver the fluid from the fluid ejecting device, thereby reducing the chance of contamination. In some applications, the consumer devices may be inexpensive enough to allow them to be used in a disposable manner.

Figure 4:
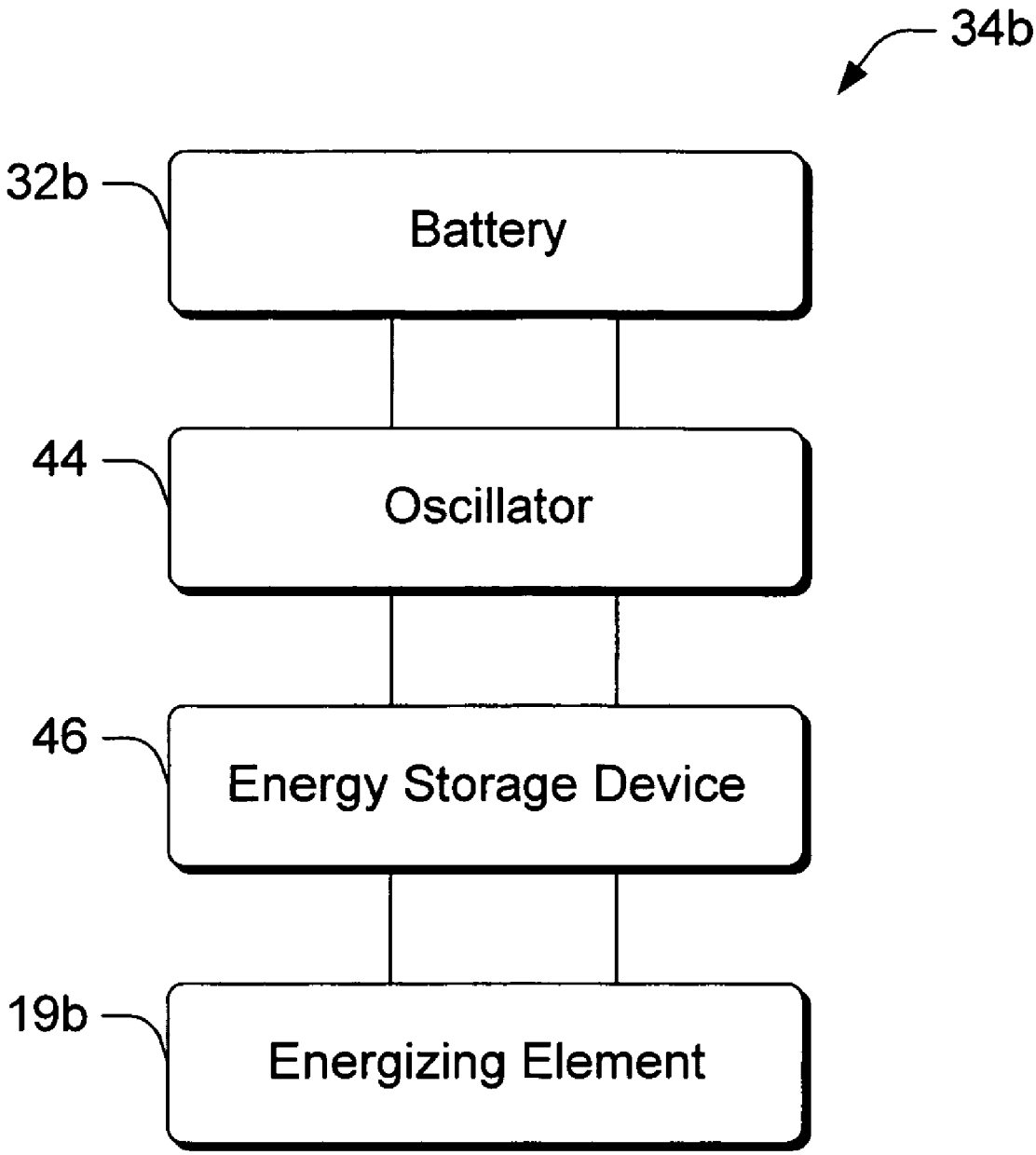
FIG. 4 shows a block diagram of components of an exemplary circuit in accordance with one embodiment.

FIG. 4 shows an overview of the functional components of one exemplary energizing circuit 34*b* comprising a direct current (DC) power source such as a battery 32*b*, an oscillator 44, an energy storage device 46, and an energizing element 19*b*. The battery 32*b* is connected to the oscillator 44 that converts the DC power from the battery to alternating current (AC). The oscillator 44 delivers power to the energy storage device 46 which can comprise an inductor, a capacitor, or a capacitor in combination with an avalanche device, among others. The energy storage device 46 stores a desired amount of energy that is subsequently delivered to energizing element 19*b* as a suitable pulse of energy to activate the energizing element.

Figure 5:
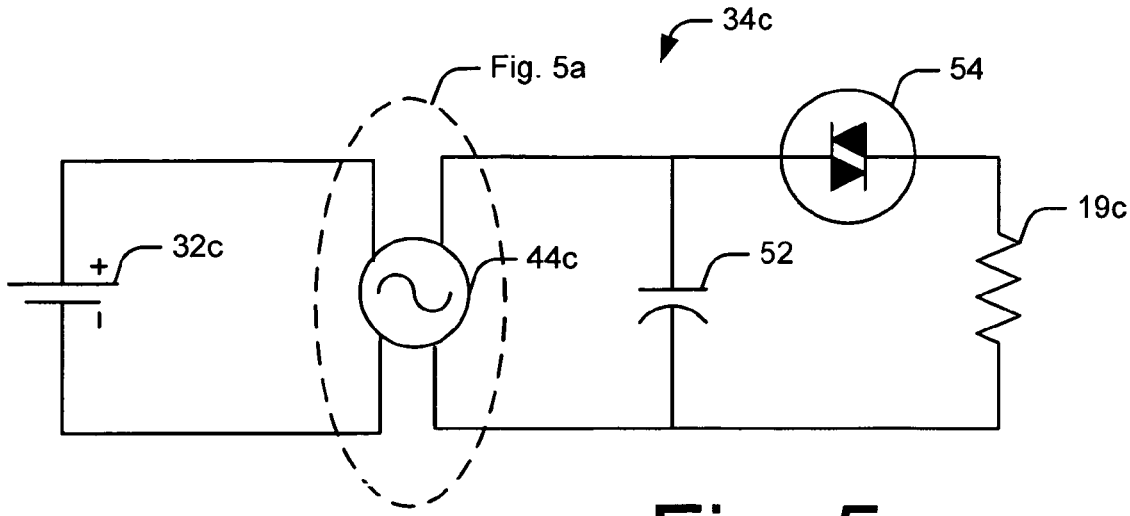
FIGS. 5-5*a* show diagrams of components of an exemplary circuit in accordance with one embodiment.
Figure 6:
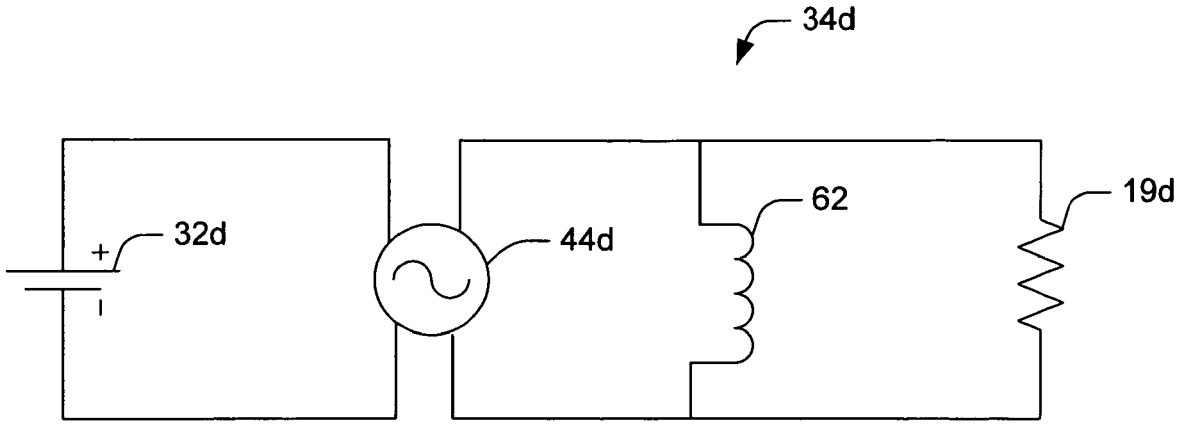
FIG. 6 shows a diagram of components of an exemplary circuit in accordance with one embodiment.

FIGS. 5 and 6 show exemplary energizing circuits. Each of the energizing circuits stores energy from a power source and can deliver the stored energy as a pulse of energy suitable to activate an energizing element of a fluid ejecting device sufficient to cause fluid to be ejected therefrom.

FIG. 5 shows an exemplary energizing circuit 34*c* that comprises a power source comprising a battery(s) 32*c*, an oscillator 44*c*, an energy storage device comprising a capacitor 52, an avalanche device comprising a diac 54, and an energizing element comprising a firing resistor 19*c*. The battery 32*c* is electrically coupled to the oscillator 44*c* that is coupled in parallel with the capacitor 52 and the energizing element 19*c*. The diac 54 is positioned in series between the capacitor 52 and the firing resistor 19*c*.

Various suitable battery(s) 32*c* can be utilized. Some exemplary embodiments can utilize standard, commonly available batteries such as one or more 1.5v (volt) "AA" penlight batteries, among others. Such readily available batteries can provide an added degree of convenience for a user. Other battery types and/or voltages can provide suitable embodiments as will be recognized by the skilled artisan. Though a battery is utilized as the power source in the described embodiments, other suitable power sources, such as capacitors or fuel cells, can also be utilized in place of, or in combination with a battery(s).

The oscillator 44*c* utilized in FIG. 5 can be any suitable oscillator or similar functionality. The characteristics of the oscillator can be selected depending on the voltage of the power source and the specifications of the energizing element among other. For example, if a relatively low voltage power source like a 1.5v battery is utilized, an oscillator capable of stepping-up the voltage can be utilized. One such suitable oscillator will be described in more detail below in relation to FIG. 5*a*. Other suitable embodiments can utilize a battery having a higher voltage and thus may or may not utilize an oscillator having step-up capabilities.

In the embodiment shown in FIG. 5, DC energy is supplied from the battery 32*c* to the oscillator 44*c* which converts the energy to AC and in this case steps up the voltage. The AC energy charges the capacitor 52. In this embodiment, the oscillator 44*c* charges the capacitor 52 until the voltage across the capacitor reaches a predetermined value of the diac 54 which is a voltage sensitive switch. As such, when voltage is applied to the diac, it remains in a turned off state until the voltage reaches the predetermined value (which in this embodiment is 40v) at which point it turns on or fires. At this point the diac 54 displays a negative resistance and the energy stored in the capacitor 52 flows through the diac 54 and the energizing element 19*c* until a second lower value of the diac is reached, at which point the diac turns off and flow stops. The capacitor 52 begins to recharge allowing time for the fluid ejecting device to refill before the process is repeated. Though a diac is utilized in this embodiment, other suitable embodiments can utilize other avalanche devices such as Zener diodes and Shockley diodes, among others.

In the embodiment shown in FIG. 5, the capacitor 52 comprises a 0.6 microfarad capacitor and the diac 54 has a 40v potential. Other suitable embodiments can utilize other values depending on the properties of the various components comprising a suitable energizing circuit. The frequency of triggering the avalanche device (diac) followed by recharging the capacitor can be controlled, at least in part, by the frequency of the oscillator, and the value of the capacitor. Various firing rates of the fluid ejecting device's energizing element can be utilized. For example, some embodiments can utilize an energizing element that functions at about 20 kHz. Some other embodiments can utilize an energizing element that function at about 40 kHz. Still other embodiments can utilize an energizing element that function at a value between about 20 kHz and about 40 kHz. Further embodiments can utilize energizing elements that function outside of these values. Suitable components can be combined to achieve a desired firing rate.

Figure 5A:
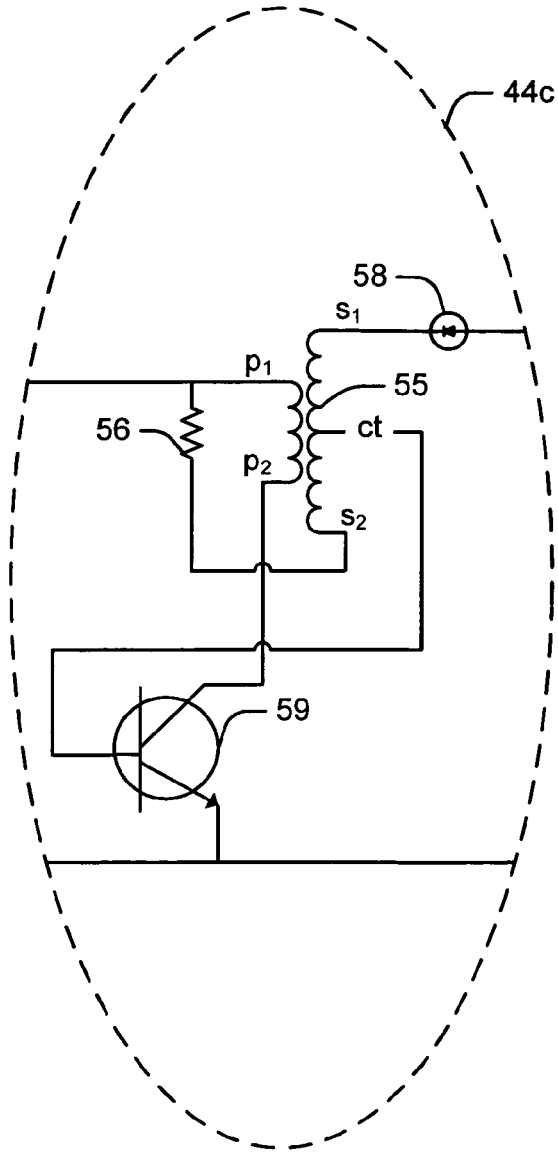

FIG. 5*a* shows a more detailed view of an exemplary oscillator 44*c* as shown in FIG. 5. In this embodiment, the oscillator comprises a transformer 55, a resistor 56, a diode 58, and a transistor 59. The transformer 55 has a primary ($p_1$) coupled to the positive side of the battery 32*c* (shown FIG. 5). The positive side of the battery is also connected to the transformer's secondary ($S_2$) via the resistor 56. The transformer's other secondary ($s_1$) is connected to the capacitor 52 (shown FIG. 5) via diode 58. The transformer's center tap (ct) is connected to the base of npn transistor 59. The collector of the transistor 59 is connected to the transformer's other primary ($p_2$). The emitter of the transistor 59 is connected to the negative side of the battery 32*c* (shown FIG. 5) and the opposite pole of capacitor 52 (shown FIG. 5) as the transformer's secondary $s_1$.

In the oscillator 44*c* shown in FIG. 5*a*, the transistor 59 pulses on and off making the transformer 55 oscillate. The transformer has a split winding on the right hand side that feeds the base of the transistor 59. Though an npn transistor is shown here, similar functionality could be achieved with a MOSFET, among others. This exemplary configuration provides feedback through the transistor that turns the oscillator off. The transistor subsequently stops providing feedback and the oscillator turns back on.

The transformer 55 can produce a desired secondary voltage depending on the "turns ratio" of the transformer as will be recognized by the skilled artisan. The output of the oscillator 44*c* charges the capacitor 52; the diode 58 prevents discharge back through the oscillator. In one particular embodiment, the transformer output from the secondaries ($s_1$ and $s_2$) is a higher voltage than the diac 54. In this embodiment, the diac directly controls the flow of energy into the energizing element 19*c*, though other embodiments can utilize a silicon controlled rectifier "SCR" positioned between the diac 54 and the energizing element 19*c*. The SCR can be connected between the diac and the energizing element so that the diac would trigger the SCR that would then activate the energizing element with a higher current.

In this embodiment, the energizing circuit 34*c* provides a desired, controlled-amount pulse of energy to the energizing element 19*c*. The value of the energy pulse is controlled by the capacity of the capacitor 52 which can store a given amount of energy at a given voltage. The voltage of the capacitor is limited by the diac 54 in this embodiment. The capacitor and diac can be selected to deliver a desired energy pulse and not to deliver an undesirably powerful energy pulse.

FIG. 6 shows another exemplary energizing circuit 34*d* comprising a battery 32*d*, an oscillator 44*d*, an energy storage device comprising an inductor 62, and an energizing element 19*d* that in this embodiment comprises a firing resistor. The oscillator 44*d*, the inductor 62, and the energizing element 19*d* are connected in parallel with the battery 32*d*.

The battery 32*d* provides DC current to the oscillator 44*d* which outputs pulses of energy through the inductor 62. The oscillator acts as a switch that periodically provides a pulse of a desired pulse width. The power output from the oscillator 44*d* charges the inductor 62 which can store energy in a magnetic field. The inductor can discharge the stored energy in a pulse sufficient to activate the energizing element 19*d*. In this embodiment, where a 1.5v battery is utilized as the power source, the inductor 62 can be selected to provide a desired voltage gain based on the windings of the inductor as will be recognized by the skilled artisan.

A given inductor can store a finite amount of energy in its magnetic field at which point it reaches "saturation." Any additional energy is lost as heat rather than being stored in the inductor's magnetic field.

Some of the present embodiments can utilize an inductor that can store a sufficient amount of energy to activate an energizing element, but reaches saturation before enough energy can be stored to potentially damage a given energizing element. Selecting an inductor that reaches saturation when a desired amount of energy is stored in its magnetic field can have a further advantage of allowing the energizing circuit to operate with a wider range of power source voltages.

In some of the described embodiments, an activating pulse having a desired voltage level can be achieved by choosing an inductor that can receive energy from the oscillator and create an inductive kickback that produces a higher voltage. Such a configuration can allow relatively low voltage power sources such as a 1.5v battery to power an energizing circuit that delivers energizing pulses of 40v or more.

For example, in an embodiment employing a 1.5v AA battery, a brand new battery may supply approximately 1.6v. The battery may have a lower useful value of approximately 1.0v before being replaced or recharged. An inductor can be chosen to deliver a desired activating pulse and reach saturation when the battery is at its lower useful range of about 1.0 volts. Thus the inductor stores the maximum amount of energy in its magnetic field and just reaches saturation when supplied with about 1.0v from the power source.

When a fresh battery of about 1.6v is positioned in the circuit, the inductor stores substantially the same amount of energy as it did when supplied with 1.0v and thus reduces the chance of the energizing element being damaged from being overcharged. Thus, by choosing a suitable inductor for use with a specific energizing element and battery (power source), a desired activating pulse can be achieved across the effective lifespan of the battery without any other regulation of the energizing circuit.

Figure 7:
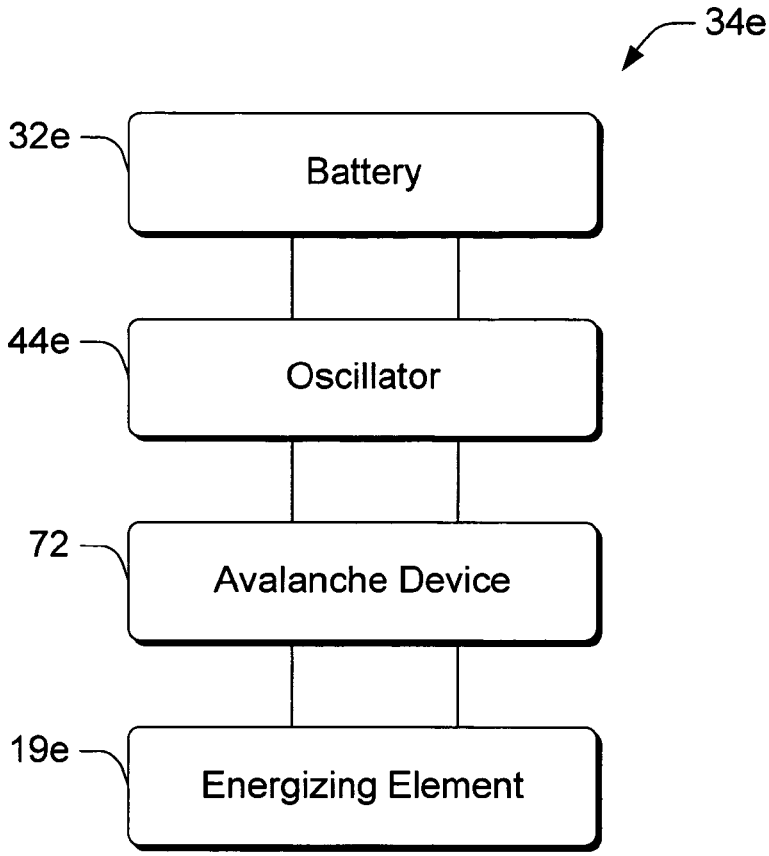
FIG. 7 shows a block diagram of components of an exemplary circuit in accordance with one embodiment.

FIG. 7 shows an overview of the functional components of another exemplary energizing circuit 34*e* comprising a direct current (DC) power source such as a battery 32*e*, an oscillator 44*e*, an avalanche device 72, and an energizing element 19*e*. The battery 32*e* is connected to the oscillator 44*e* that converts the DC power from the battery to alternating current (AC). The oscillator 44*e* delivers power to avalanche device 72 and energizing element 19*e*. Examples of suitable avalanche devices include diacs, triacs, and SCRs, among others. This particular energizing circuit configuration can be especially performant where the energizing element 19*e* acts, at least some degree as a charge storage device. For instance, the energizing element may have capacitive properties which allow it to store energy. For example, various types of piezoelectric actuators or devices have capacitive properties compatible with such a configuration. In one such configuration, the oscillator charges the avalanche device and the energizing element until the avalanche device is triggered and activates the energizing element sufficient to eject fluid from the ejection chamber. For instance, the energizing element may be activated by a sudden electrical discharge caused by the triggering of the avalanche device. The avalanche device subsequently resets and the process is repeated.

Figure 8:
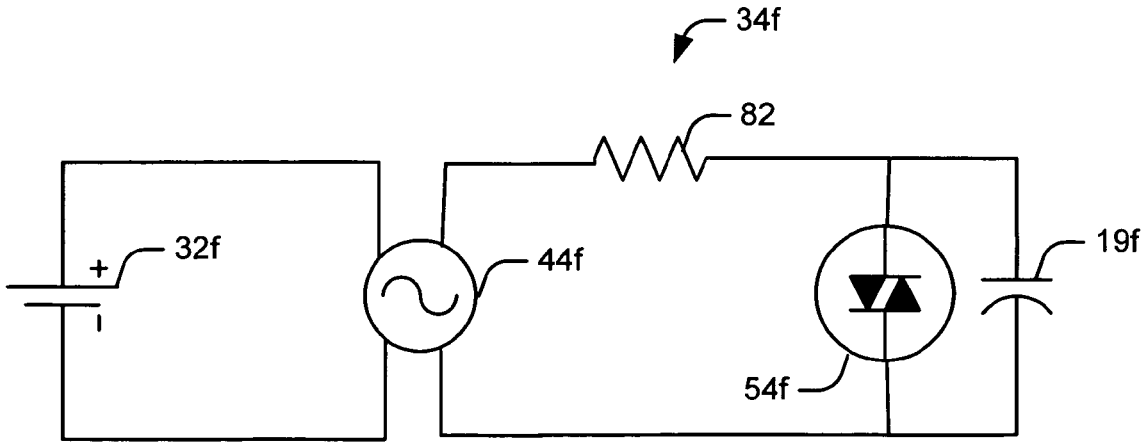
FIG. 8 shows a diagram of components of an exemplary circuit in accordance with one embodiment.

FIG. 8 show an example of an energizing circuit 34*f* consistent with the concepts described in relation to FIG. 7. Energizing circuit 34*f* stores energy which can activate an energizing element of a fluid ejecting device sufficient to cause fluid to be ejected therefrom.

Energizing circuit 34*f* includes a power source comprising a battery(s) 32*f*, an oscillator 44*f*, a resistor 82, an avalanche device comprising a diac 54*f*, and an energizing element 19*f* comprising a piezoelectric actuator. In this implementation, the piezoelectric actuator is represented as a capacitor. The battery 32*f* is electrically coupled to the oscillator 44*f*. The diac 54*f* and the energizing element 19*f* are coupled in parallel to the oscillator 44*f*. Resistor 82 is interposed in series between the oscillator on one side and the avalanche device and energizing element on the other. Resistor 82 is an optional component of any of the above described circuits and allows the cycle time of the circuit to be adjusted when the resistance of the resistor is selected relative to the system configuration. Some implementations may utilize a variable resistor to facilitate easier cycle time adjustment such as during manufacture and/or by a consumer.

In the particular circuit configuration illustrated here, oscillator 44*f* charges the diac 54*f* and energizing element 19*f*. Charge is stored in the energizing element until the upper predetermined value of the diac is reached and at which point the diac 'turns-on' or fires. At this point, sufficient energy is available to actuate the energizing element 19*f*. In some instances the actuation is caused by a sudden discharge of stored energy from the energizing element due to the triggering of the avalanche device. Eventually, the diac reaches a second lower value and the diac turns off and flow stops. The cycle is then repeated. Some implementations may include a separate energy storage device within the circuit which causes additional energy storage beyond the storage capacity of the energizing element.

Exemplary Methods

Figure 9:
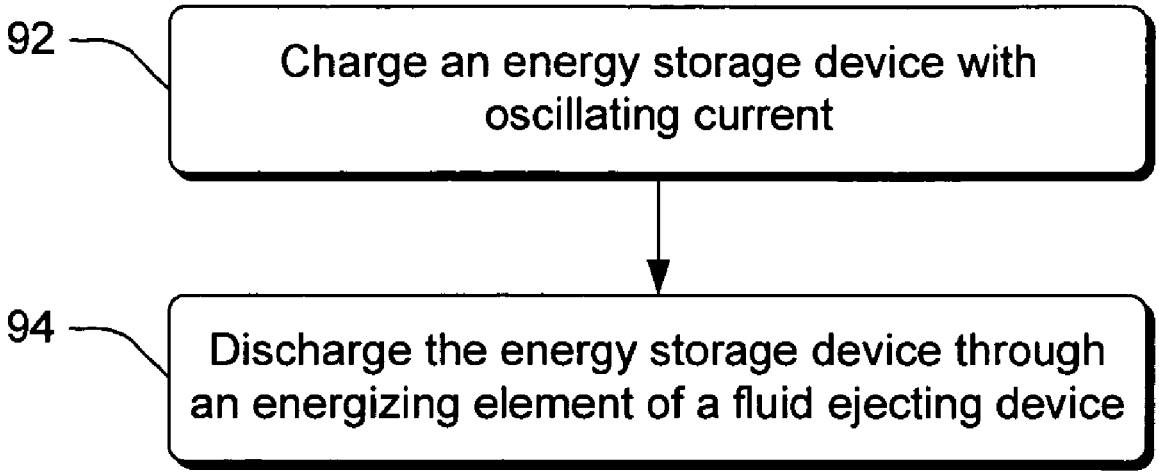
FIG. 9 shows a flow diagram indicating acts in an exemplary method in accordance with one embodiment.

FIG. 9 illustrates an exemplary fluid ejecting method. In this implementation, the method charges an energy storage device with oscillating current at 92. Such an act can allow energy to be stored in the energy storage device. Some implementations can achieve this act by creating oscillating current having a desired frequency. This can be achieved, among other ways, by coupling an oscillator to a DC power source as described above. The oscillator can be chosen based on a desired firing frequency for a given energizing element. In one such example, firing resistors can be employed as suitable energizing elements. Many firing resistors provide suitable functionality in a fluid ejecting device operating at about 20 to 40 kHz (kilohertz), as described above. Such a frequency can allow for fluid to be replenished in the fluid ejecting device prior to the next pulse.

Some suitable implementations can utilize an inductor as a suitable energy storage device. These implementations can store energy inductively in the inductor's magnetic field. A suitable inductor can be chosen based on the other components comprising a particular implementation. Some of these implementations can prevent damage to the energizing element by selecting an inductor that reaches saturation at or near a value which will deliver a desired pulse thus preventing overcharging and potentially damaging the energizing element. FIG. 6 provides an example of a circuit configuration consistent with such a process.

Other suitable implementations can similarly store energy capacitively where a capacitor comprises the energy storage device. The capacitance of the capacitor at a given voltage can be selected to supply the desired pulse. The capacitor can be utilized in conjunction with an avalanche device that is automatically triggered when a predetermined threshold is met. The predetermined threshold can be the desired voltage of the firing pulse. The avalanche device in combination with the capacitor can store energy defining a desired pulse which can be delivered when the predetermined condition of the avalanche device is met. FIGS. 7-8 provide an example of a circuit configuration consistent with such a process.

The method further discharges the energy storage device through an energizing element of a fluid ejecting device sufficient to eject fluid from the fluid ejecting device at 94. A suitable energy storage device can deliver a pulse of energy of sufficient energy to activate the energizing element while limiting the pulse of energy to reduce the chance of damaging the energizing element. Such a circuit can be achieved by combining components that deliver an energy pulse suitable for a given energizing element.

CONCLUSION

The described embodiments can provide methods and systems for simple, relatively inexpensive energizing circuits for activating a fluid ejecting device. The energizing circuits can store energy that is subsequently delivered to a fluid ejecting device's energizing element sufficient to cause fluid to be ejected. The component of a given energizing circuit can be selected to provide energy pulses sufficient for a given energizing element while limiting the pulse of energy to prevent damage to the energizing element.

Although the invention has been described in language specific to structural features and methodological steps, it is to be understood that the invention defined in the appended claims is not necessarily limited to the specific features or steps described. Rather, the specific features and steps are disclosed as forms of implementing the claimed invention.

What is claimed is:

1. An energizing circuit comprising:

an oscillator electrically configured to provide AC power;

an energizing element configured to eject fluid from a fluid ejecting device; and, an avalanche device electrically coupled in parallel with the energizing element to the oscillator, and wherein upon the avalanche device being charged to a predetermined value by the oscillator, the avalanche device automatically triggers to cause the energizing element to be activated sufficiently to eject fluid from the fluid ejecting device.

2. The energizing circuit of claim 1, wherein the energizing element comprises a piezoelectric actuator.

3. The energizing circuit of claim 1, wherein the energizing element acts as an energy storage device.

4. The energizing circuit of claim 1, wherein the avalanche device comprises a diac.

5. The energizing circuit of claim 1 further comprising a resistor coupled in series between the oscillator and both of the energizing element and the avalanche device.

6. The energizing circuit of claim 5, wherein the resistor comprises a variable resistor.

7. A consumer device incorporating the energizing circuit of claim 6 and being configured so that a user can adjust a cycling rate of the energizing circuit by adjusting the variable resistor.

8. A consumer device incorporating the energizing circuit of claim 1.

9. A fluid ejecting device comprising:

an oscillator;

an avalanche device; and, an energizing element electrically coupled to the avalanche device and the oscillator and being configured to store energy until the avalanche device is triggered at a predetermined value which automatically causes a discharge of the energizing element sufficient to cause fluid to be ejected from the fluid ejecting device.

10. The fluid ejecting device of claim 9, wherein the avalanche device comprises one of: a diac, a triac, and a silicon controlled rectifier.

11. The fluid ejecting device of claim 9, wherein both of the energizing element and the avalanche device are coupled in parallel with the oscillator.

12. The fluid ejecting device of claim 9 further comprising a different energy storage device coupled to the energizing element.

13. The fluid ejecting device of claim 9 further comprising a resistor coupled in series between the oscillator and both of the energizing element and the avalanche device.

14. An energizing circuit comprising:

an energizing element; and, an avalanche device electrically coupled to the energizing element and configured to receive alternating current, the avalanche device configured to automatically cause a discharge of energy stored in the energizing element sufficient to activate the energizing element when a predetermined condition of the avalanche device is met.

15. The energizing circuit of claim 14, wherein the energizing element comprises a piezoelectric actuator.

16. The energizing circuit of claim 14, wherein the avalanche device comprises a diac.

17. The energizing circuit of claim 14, wherein the energizing element acts as an energy storage device.

18. The energizing circuit of claim 14, wherein the predetermined condition comprises a desired voltage level of the energizing element.

19. A consumer device incorporating the fluid ejecting device of claim 14.

20. A fluid ejecting device, comprising:

a piezoelectric actuator configured to selectively eject fluid from the fluid ejecting device; and, an avalanched device electrically coupled to the piezoelectric actuator and configured to be triggered at a predetermined voltage level, and wherein the triggering of the avalanche device causes the piezoelectric actuator to be activated sufficiently to cause fluid to be ejected from the fluid ejecting device.

21. The fluid ejecting device of claim 20 further comprising an oscillator coupled in parallel to both of the piezoelectric actuator and the avalanche device.

22. The fluid ejecting device of claim 21 further comprising a resistor coupled in series between the oscillator and both of the piezoelectric actuator and the avalanche device.

* * * * *

UNITED STATES PATENT AND TRADEMARK OFFICE

CERTIFICATE OF CORRECTION

PATENT NO. : 7,387,353 B2
APPLICATION NO. : 11/079128
DATED : June 17, 2008
INVENTOR(S) : Thomas A. Saksa It is certified that error appears in the above-identified patent and that said Letters Patent is hereby corrected as shown below:

On the title page, in field (57), under "Abstract", in column 2, line 5, delete "avalanched" and insert -- avalanche --, therefor.

In column 8, line 10, in Claim 9, delete "clement" and insert -- element --, therefor.

In column 8, line 50, in Claim 20, delete "avalanched" and insert -- avalanche --, therefor.

Signed and Sealed this

Ninth Day of December, 2008

JON W. DUDAS
*Director of the United States Patent and Trademark Office*